United States Patent [19]

Quick

[11] 4,183,770

[45] Jan. 15, 1980

[54] APPARATUS AND PROCESS FOR CLEANING FILLED CAPSULES

[75] Inventor: Lloyd A. Quick, Brockville, Canada

[73] Assignee: Warner-Lambert Company, Morris Plains, N.J.

[21] Appl. No.: 909,322

[22] Filed: May 24, 1978

[51] Int. Cl.[2] ..... B08B 1/04

[52] U.S. Cl. ..... 134/6; 15/305; 134/21; 134/25 R

[58] Field of Search ..... 134/6, 21, 25 R, 33; 51/164; 15/305, 306 B, 230.19, 230.17

[56] References Cited

U.S. PATENT DOCUMENTS

| | | | |
|---|---|---|---|
| 3,302,232 | 2/1967 | Wasiloff et al. | 15/230.17 |
| 3,592,689 | 7/1971 | Chaplinski | 134/25 R X |
| 4,058,868 | 11/1977 | Champion | 15/305 X |

*Primary Examiner*—Richard V. Fisher

*Attorney, Agent, or Firm*—David B. Ehrlinger; Frank S. Chow; Stephen Raines

[57] ABSTRACT

Cleaning apparatus for filled capsules including in combination a rotary drum for tumbling the capsules, napped or tufted fabric liner means for the drum such that uncleaned capsules during tumbling are rubbed by the nap of the fabric and are thereby cleansed of particulate matter, and vacuum means for removing particulate matter from the nap of the fabric; and a process for cleaning filled capsules.

4 Claims, 5 Drawing Figures

APPARATUS AND PROCESS FOR CLEANING FILLED CAPSULES

SUMMARY AND DETAILED DESCRIPTION

The present invention relates to cleansing apparatus for filled capsules. More particularly, the invention relates to such apparatus including a rotary drum for tumbling the capsules, a napped or tufted fabric liner for the drum, and vacuum cleaning means for the nap of the fabric; and to a process of cleaning filled capsules by tumbling the same in a drum and vacuum cleaning the drum.

Prior to the present invention, the cleaning of filled capsules covered with unwanted dust, powder, and other particulate matter was conventionally done by hand polishing on cheesecloth, by tumbling in salt, or by placing the capsules between moving lambswool belts. In another method, using apparatus described in U.S. Pat. No. 4,058,868, cleaning of filled capsules is done first by blowing the capsules against an electrically charged screen to rid them of dust and then for residual cleaning, by tumbling them in a rotating inclined drum having a lining of napped fabric. The difficulty with the prior art methods is that they either are inefficient or are expensive or require special apparatus not generally available.

It is therefore an object of the present invention to provide improved means for cleaning filled capsules.

It is also an object to provide economical, efficient means for cleaning capsules.

These and other objects, purposes and advantages will be seen by reference to the following description and accompanying drawing in which.

According to the present invention, apparatus for cleaning filled capsules is provided comprising in combination a rotary drum adapted for tumbling the capsules, napped or tufted fabric having anti-static properties and installed as a liner for the drum such that uncleaned capsules during tumbling are rubbed by the nap of the fabric whereby the exterior surface of each capsule is cleansed of particulate matter by such rubbing action, and vacuum cleaning means for the nap of the fabric adapted for removing particulate matter from the nap of the fabric during tumbling. The invention also provides a process for cleaning capsules comprising rubbing particulate matter from the surface of the capsules by tumbling the same in rotary drum means having an anti-static liner comprising napped or tufted fabric and cleaning the nap of the fabric during tumbling by vacuum cleaning means.

The invention advantageously avoids the processing of capsules by hand and makes for prompt, economical cleaning of capsules while controlling environmental dust without resort to special or complex equipment.

Figure 1:
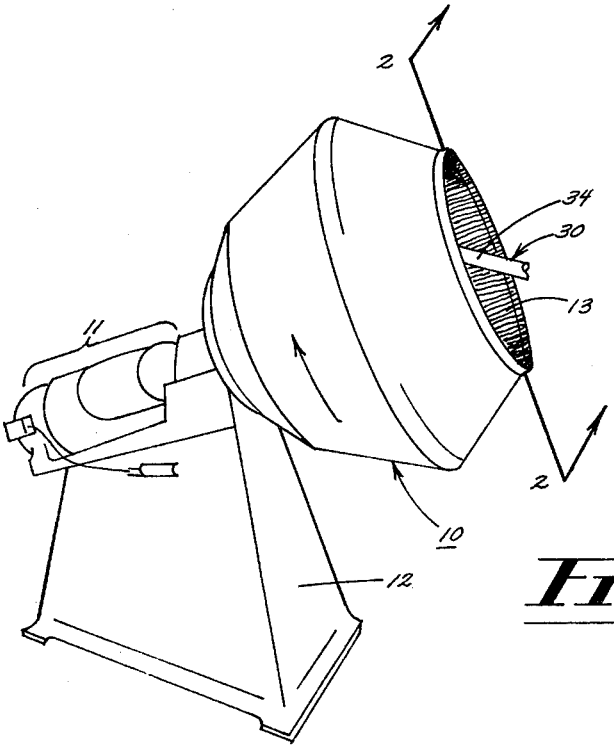
FIG. 1 is a view in perspective of a rotary drum or coating pan and stand.
Figure 2:
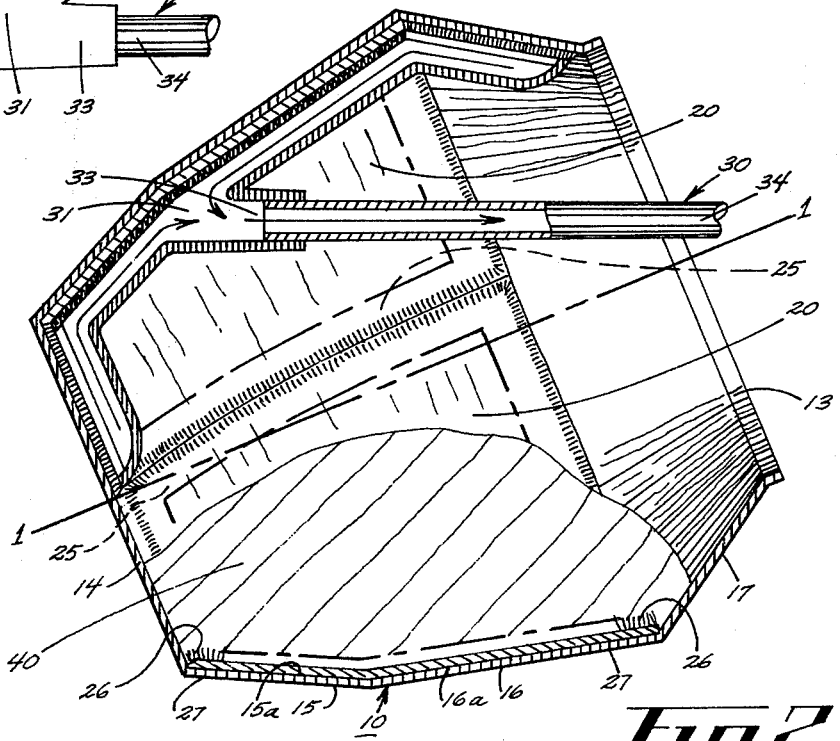
FIG. 2 is a sectional view of the rotary drum of FIG. 1 taken on line 2—2.
Figure 4:
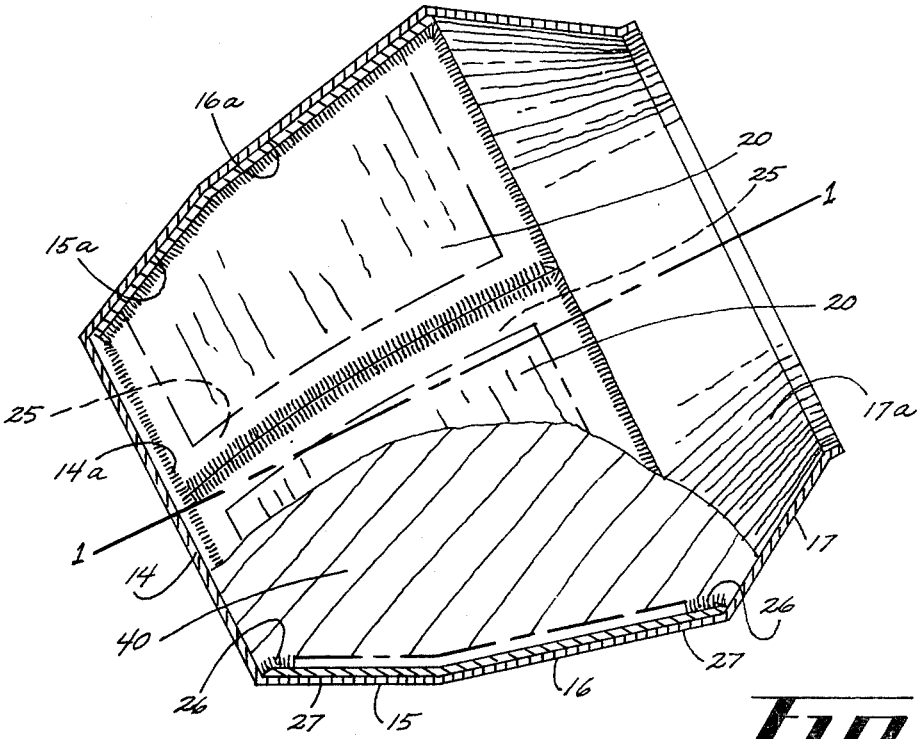
FIG. 4 is a view similar to FIG. 2 but with the vacuum wand removed.
Figure 5:
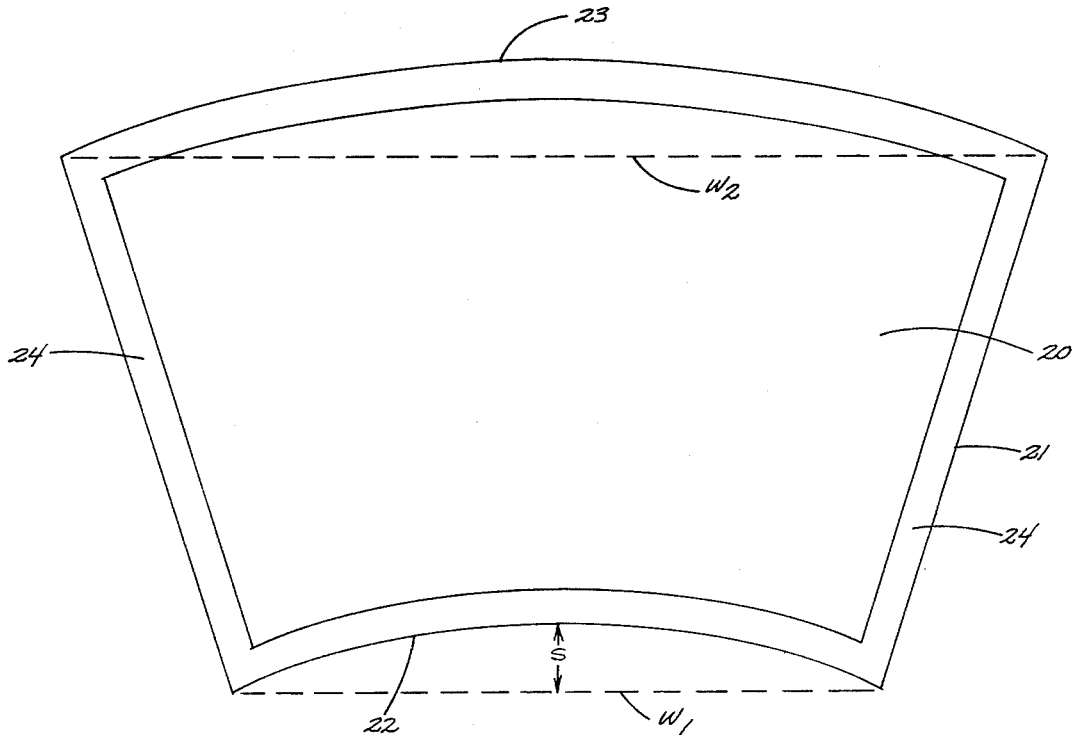
FIG. 5 is a view of a fabric liner for the rotary drum.

Referring to the drawing, which is an illustration of a preferred embodiment of the invention, FIG. 1 shows a rotary drum or coating pan 10 mounted for axial rotation (about line 1—1 of FIG. 2) by a motor and drive train 11 supported on a pan stand 12. The drum 10 as seen in FIG. 2 is hollow and has a circular opening 13 at the top and a flat circular base 14. The side wall of the drum is subdivided into a lower wall 15, a middle wall 16, and an upper wall 17. The drum is fabricated from sheet metal and the inner surface is smooth and continuous. As a liner for the inner surfaces **15*a* and 16*a* of the lower and middle walls, fabric panels 20 are fastened in covering relation to these surfaces as better seen in FIG. 4. The nap of each panel extends completely across the panel but for convenience of illustration is shown only on the outer margins of the panel. The inner surfaces 14*a* and 17*a* of the base and upper wall, respectively, are left uncovered. In the embodiment illustrated, the configuration of the panel 20 is such that three panels laid edge to edge circumferentially around the drum are in matching engagement with and completely cover the inner surfaces 15*a* and 16*a*. Each such panel, as illustrated in FIG. 5, which shows the reverse or unnapped side of the panel, has a fan shape when laid flat with side edges 21 and arcuate bottom and top edges 22 and 23. For use with a standard 24-inch pan or drum having a 15-inch base and 24-inch maximum diameter (at the top of the middle wall), the panel widths $W_1$ and $W_2$ are about 16 inches and $24\frac{5}{8}$ inches, respectively. The distance S between edge 22 and the middle of line $W_1$ is about $1\frac{3}{4}$ inches. The fabric used for the panel has a fur-like nap pile or tuft 26 (suitably about $\frac{3}{8}$-inch thick) and backing 27 as seen in FIGS. 2 and 4. As a fastening means, hooked fabric tape 24 (suitably about one inch in width) is attached hook side out to the margins of the panel 20. The tape can be attached in any suitable manner as by adhesive (e.g. rubber cement) or by sewing. Similar and corresponding dimensioned looped fabric tape 25 is fastened to the inner walls of the drum (surfaces 15*a* and 16*a*) in positions as illustrated such that the loops are exposed for engagement with the hooks of tape 24** of each of the respective panels, thereby permitting convenient installation and removal of each panel, as desired.

Figure 3:
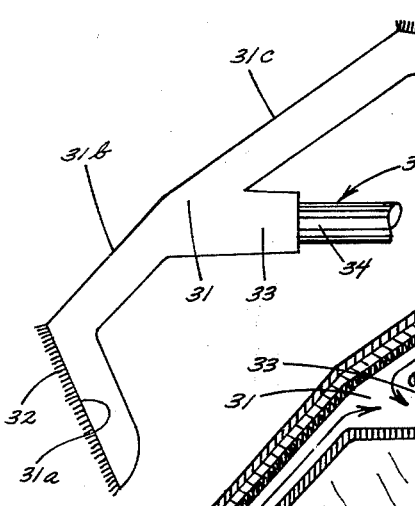
FIG. 3 is a side view of a vacuum wand shown in section in FIG. 2.

For cleaning dust and other particulate matter from the interior of the rotary drum, a vacuum, wand 30 (FIG. 3) is provided. The wand has a rigid nozzle 31 which is hollow. The nozzle presents four faces **31*a*, 31*b*, 31*c* and 31*d* which are contoured to fit closely against the drumwall at the covered or uncovered inner surfaces 14*a*, 15*a*, 16*a* and 17*a*, respectively, as seen in FIG. 4. These four faces have openings (not shown) evenly distributed along the length of each face, preferably as lengthwise slots. The size and shape of the openings are not critical. Also, the end faces 31*a* and 31*d* each carry a brush 32 along the length of the face which functions, when placed against the drumwall, to wipe dust from the wall surfaces 14*a* and 17*a*. The nozzle 31 has a hollow neck 33 connected with a rigid conduit 34 which is part of the wand 30 and is in open communication with a vacuum source (not shown). For setting up, the wand is installed into the drum containing a bed 40 of capsules (FIG. 4) to the position shown in FIG. 2. In the latter position, the faces of the wand are held stationary against the drumwall by any suitable means such as immobilizing the conduit 34** by means of an external base-mounted clamp (not shown) attached to the conduit.

OPERATION

The operation of the apparatus of the invention will now be described in reference to a specific type of filled capsule which is generally regarded to be a problem in cleaning, particularly as to electrostatic buildup which makes it difficult to remove dust from the capsule. This is the No. 3 hard shell capsule, locking type, filled with powder comprising phenytoin sodium. It will be realized, however, that the invention is applicable broadly to filled capsules of various descriptions and kinds.

The lower and middle inner walls of a 24-inch coating pan (Stokes coating stand described above, pan shaft RPM, 30; supplied by Production Equipment Inc., division of Durmat Co., Rochelle Park, N.J.) are first taped in preparation for lining with napped fabric. The taping is done with looped fabric tape in three marginal sectors corresponding to the tape configuration 24 shown in FIG. 4. The tape is fastened in the pan, preferably by adhesive such as rubber contact cement, and is thus located in the designated (25, FIG. 2) areas of the lower and middle wall surfaces 15*a* and 16*a*. Each of three fabric panels 20 is then attached by the hooked fabric tape 24 to the respective looped fabric tape 25 so that the inner surfaces 15*a* and 16*a* of the drum are completely lined by the fabric liner with the nap side out, leaving the surfaces 14*a* and 17*a* uncovered. A load 40 of uncleaned filled capsules (15,000 capsules, No. 3 hard shell, locking type, filled with powder comprising phenytoin sodium) is filled into the drum. The vacuum wand 30 is placed into the drum, so that the nozzle faces 31*a*, 31*b*, 31*c* and 31*d* are fitted topward of the drum closely against the wall surfaces 14*a*, 15*a*, 16*a* and 17*a*, and the wand is made stationary in this position by a base-mounted clamp fastened onto the conduit 34 (1½ inch I.D.) of the wand. Vacuum is drawn on the wand through a 1½ inch flexible hose with a vacuum cleaner machine rated at 120 cubic feet per minute (Clarke Model 612, 1½ H.P., 115 V, 12 A.). The drum is then rotated at 30 RPM for one-half hour while the vacuum wand under suction is pulling air from the inner lined and unlined surfaces of the drum. In this way, the capsule bed 40 is tumbled against the napped fabric which serves to rub the dust and other particulate matter from the exterior of each randomly contacting capsule so that as the fabric liner 20 rotates it continuously carries with it an entrained quantity of the unwanted particulates. Then, as the liner rotates further, it is carried out of the bed until it comes into contact with the vacuum wand 30 at the top of the drum where the particulates adjacent the wand faces 31*b* and 31*c* are sucked out of the liner and exhausted from the drum. Similarly, particulates carried on the unlined drum surfaces 14*a* and 17*a* are carried to the wand and are wiped off these surfaces by the wand brushes 32 and sucked out and exhausted from the drum. Dust removal advantageously is accomplished in this respect without any apparent problem of particulates being held back due to static charges. Finally, the lined and unlined drum surfaces thus cleaned are rotated back down into and through the capsule bed to complete the cycle of rotation. Each time the rotation cycle is repeated, the capsules become cleaner. The process is continued until the surface particulates are removed from the capsules, usually within about one-half hour of operation. At this time, the operation is discontinued, and the capsules thus completely cleaned are removed from the drum for inspection. The liners 20 for the drum can be used for several successive runs until soiled and, advantageously, can be removed from their loop-and-hook attachment for laundering and then replaced and used again. The fabric preferably is a non-static forming polyester pile fabric such as that offered under the name KODEL® by Eastman Chemical Products, Inc. or other suitable non-static forming pile fabric. If desired, one or more vacuum nozzles can be used and the nozzle shape can be changed to meet special requirements. For example, a narrower nozzle 31 having only two faces 31*b* and 31*c* can be used so that the vacuum effect is confined to cleaning the fabric panels only. Also, as will be apparent, any of various other shapes, sizes and configurations of the rotary drum can be used in which event the fabric panels and vacuum wand means are accordingly modified to match the dimensional requirements for each particular case.

While the invention has been set forth in considerable detail, it will be realized that the invention is subject to considerable variation in such detail without departing from the scope of the invention as hereinafter claimed.

I claim:

1. Apparatus for cleaning filled capsules comprising in combination a rotary drum coating pan adapted for tumbling the capsules, and having lower, middle and upper walls and a base, the inner surface of the upper wall and the base being unlined, napped or tufted fabric having anti-static properties and installed as a liner for the inner surface of the lower wall and the middle wall of the coating pan such that uncleaned capsules during tumbling are rubbed by the nap of the fabric whereby the exterior surface of each capsule is cleaned of particulate matter by such rubbing action, and vacuum cleaning means for the nap of the fabric adapted for removing particulate matter from the nap of the fabric during tumbling, the vacuum cleaning means including a wand nozzle contoured to fit closely against the inner surface of each of the lower, middle and upper walls and the base, the wand face including brush means operative to wipe the inner surface of the upper wall and the base during tumbling.

2. Cleaning apparatus according to claim 1 wherein the fabric is attached to the drum coating pan by loop-and-hook means enabling removable installation.

3. Cleaning apparatus according to claim 1 wherein the tufted fabric is a polyester fabric.

4. Process for cleaning filled capsules, comprising the steps of rubbing particulate matter from the surface of the capsules by tumbling a batch of the same in a rotary drum coating pan adapted for tumbling the capsules, and having lower, middle and upper walls and a base, the inner surface of the upper wall and the base being unlined, the inner surface of the lower wall and the middle wall of the coating pan being lined with napped or tufted fabric having anti-static properties such that uncleaned capsules during tumbling are rubbed by the nap of the fabric whereby the exterior surface of each capsule is cleaned of particulate matter by such rubbing action, and cleaning the unlined pan surface and the nap of the fabric during tumbling by vacuum cleaning means including a wand nozzle contoured to fit closely against the inner surface of each of the lower, middle and upper walls and the base, the wand face including brush means operative to wipe the inner surface of the upper wall and the base during tumbling.

* * * * *